US005766074A

United States Patent [19]

Cannon et al.

[11] Patent Number: 5,766,074

[45] Date of Patent: Jun. 16, 1998

[54] DEVICE AND METHOD FOR DISPLAYING A FINAL GAMING RESULT

[75] Inventors: Lee Cannon; John O'Donovan, both of Bozeman, Mont.

[73] Assignee: Video Lottery Technologies, Atlanta, Ga.

[21] Appl. No.: 692,575

[22] Filed: Aug. 6, 1996

[51] Int. Cl.[6] ..... A63F 9/00

[52] U.S. Cl. ..... 463/16; 463/31

[58] Field of Search ..... 463/8, 16, 30, 463/31, 33; 273/138.1, 139, 269

[56] References Cited

U.S. PATENT DOCUMENTS

| | | | |
|---|---|---|---|
| 4,491,324 | 1/1985 | Yoshida | 463/8 |
| 4,573,681 | 3/1986 | Okada | 273/143 R |
| 4,711,451 | 12/1987 | Pajak et al. | 273/143 R |
| 4,772,023 | 9/1988 | Okada | 273/143 R |
| 4,858,932 | 8/1989 | Keane | 273/143 R |
| 5,050,881 | 9/1991 | Nagao | 273/143 R |
| 5,083,785 | 1/1992 | Okada | 273/143 R |
| 5,085,436 | 2/1992 | Bennett | 273/143 R |
| 5,108,099 | 4/1992 | Smyth | 273/138 |
| 5,127,651 | 7/1992 | Okada | 273/143 R |
| 5,129,652 | 7/1992 | Wilkinson | 273/139 |
| 5,152,529 | 10/1992 | Okada | 273/143 R |
| 5,169,147 | 12/1992 | Hamano | 273/138 |
| 5,170,468 | 12/1992 | Shah et al. | 395/166 |
| 5,242,163 | 9/1993 | Fulton | 273/85 |
| 5,249,800 | 10/1993 | Hilgendorf et al. | 273/138 |
| 5,254,984 | 10/1993 | Wakeland | 345/144 |
| 5,265,874 | 11/1993 | Dickinson et al. | 273/138 |
| 5,269,523 | 12/1993 | Boylan et al. | 273/138.1 |
| 5,280,909 | 1/1994 | Tracy | 273/138 |
| 5,282,620 | 2/1994 | Keese | 273/138 |
| 5,324,035 | 6/1994 | Morris et al. | 273/138 |
| 5,326,104 | 7/1994 | Pease et al. | 273/138 |
| 5,340,119 | 8/1994 | Goldfarb | 273/439 |
| 5,388,192 | 2/1995 | Ohsawa et al. | 395/135 |
| 5,505,449 | 4/1996 | Eberhardt et al. | 273/138 A |
| 5,511,784 | 4/1996 | Furry et al. | 273/143 R |
| 5,559,950 | 9/1996 | Cannon | 395/162 |

*Primary Examiner*—George Manuel
*Attorney, Agent, or Firm*—Shook, Hardy & Bacon LLP

[57] ABSTRACT

A device and method for displaying a final gaming result, in one embodiment, displays on a video monitor the winning results in a complete manner and all non-winning results in a faded manner. In an alternate embodiment, when a game produces winning results, only the winning results of the game are displayed. Specifically, a video game device has a processor, a video monitor with display screen, and a memory for storing a bit map of the screen. Non-winning results in one embodiment are not displayed or are replaced with a background display. In another embodiment, non-winning results are displayed in a faded manner by substituting selected pixels of a collection of pixels defining an non-winning indicia to be displayed with a background or neutral display. The desired results are achieved by storing data indicative of the desired display in address locations corresponding to pixels on the screen.

8 Claims, 5 Drawing Sheets

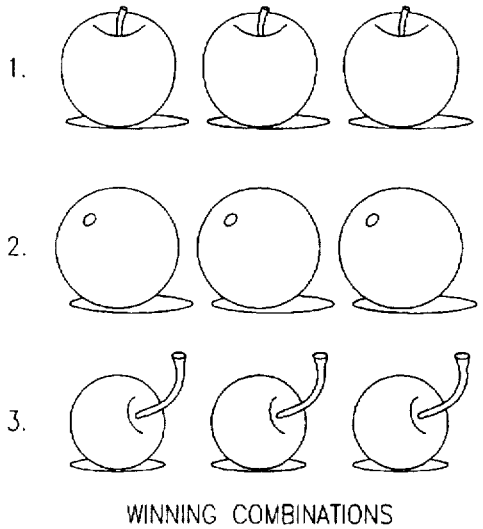
Fig. 4.
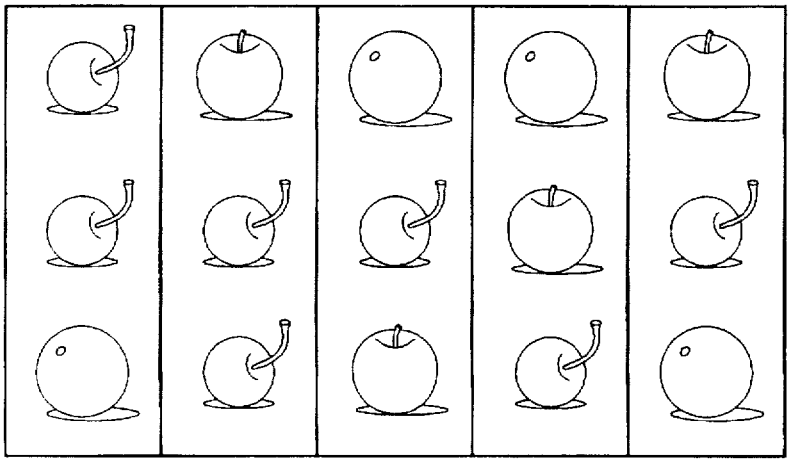
Fig. 5.
PRIOR ART
Fig. 6.
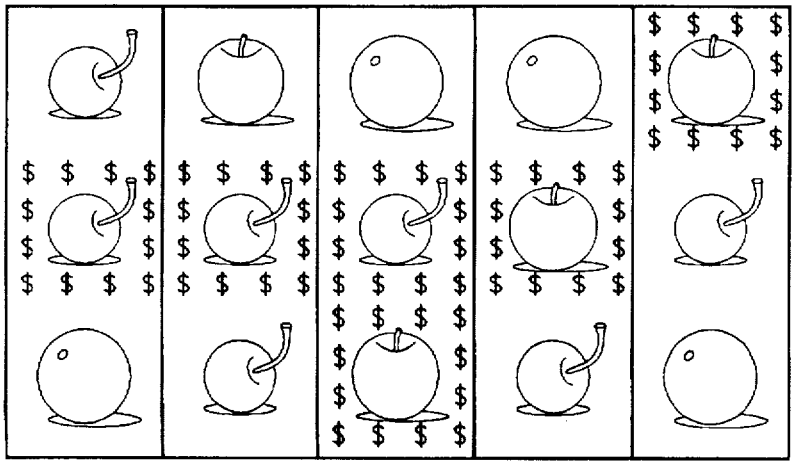

PRIOR ART
Fig. 7.
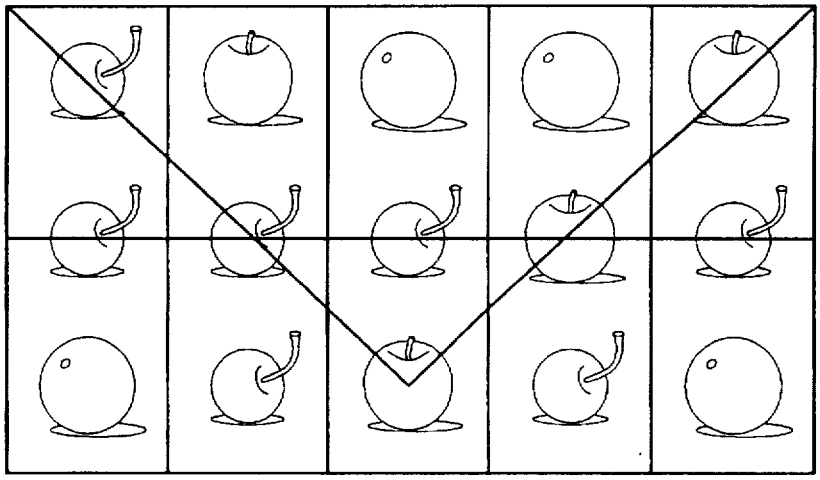
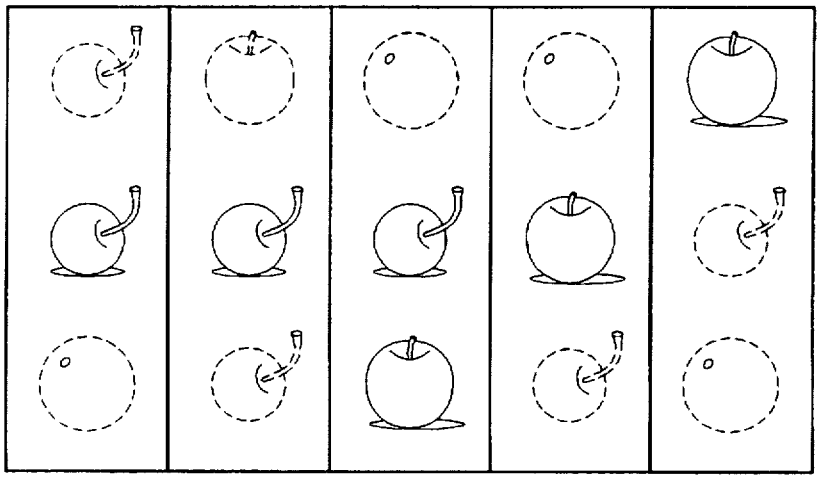
Fig. 8.
Fig. 9.
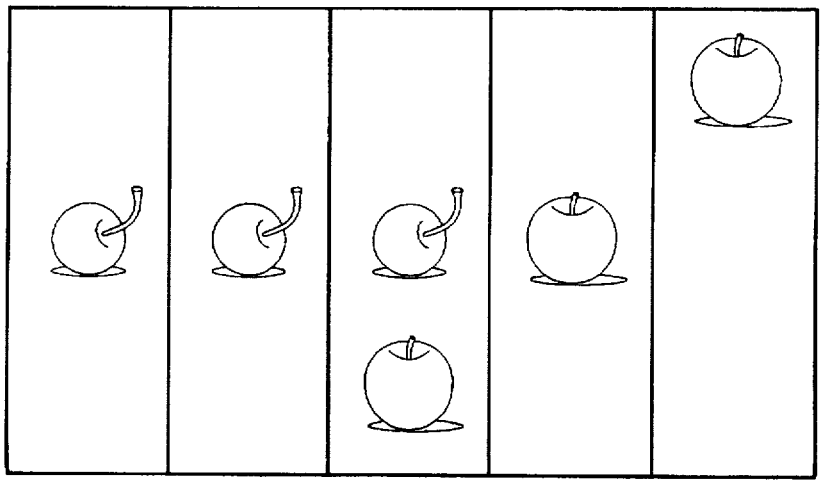

DEVICE AND METHOD FOR DISPLAYING A FINAL GAMING RESULT

BACKGROUND OF THE INVENTION

1. Field of the Invention

The present invention relates in general to a video gaming device and method of the type in which one or more games, such as games of chance, are provided to a player via a video screen. In particular, the present invention relates to an improved device and method for displaying the results of a game on a video display screen.

2. Description of the Related Art

Video gaming devices, for providing a player with a gaming experience and a visual representation of one or more games to be played, have enjoyed widespread popularity in recent years. Recent technological advancements and the development of more and new games have further increased the use and enjoyment of video gaming devices.

Video gaming devices have display monitors capable of displaying highly graphical images to the player of the game. Thus, these devices are especially useful with games of chance, where players focus on the display to determine what action to take in a particular game, or to determine whether or not they are a winner of the game being played.

Operation of conventional video gaming devices typically begins when a player inserts currency, such as a coin, bill, token, or card having an accumulated monetary value, into the device. The player then initiates the game to be played through use of an input device. For instance, depending upon the device, to start the game a player may pull a slot-arm or lever, touch a touch-screen display at the appropriate location, push a button, etc.

When played, the gaming devices randomly generate final results in the form of indicia or images that define winning or losing combinations of the indicia or images. Typically, the device will return a predetermined amount of currency to the player when the game generates a winning combination. Additionally, the final images or indicia generated by the gaming device are displayed on the video display screen to immediately provide the player with a visual indication of whether the game was won or lost.

An important consideration in the design of a video gaming device is the manner in which it displays aspects of the game and, particularly, the manner in which it displays the final results generated by the game. In this regard, since the player relies upon the display screen to operate the game, it is important that the player be able to readily determine what action to take and, especially, whether or not the game has been won once played.

In the past, two methods of displaying the final results generated by a game have been used to enhance the gaming experience and to reduce the time it takes the player to visually determine whether the final result displayed by the game includes a winning combination. One past method of displaying the final results of a game is illustrated in FIG. 6. In that method, all indicia or images within a winning combination are highlighted by adding a bordering graphic that surrounds each indicia or image in the winning combination. Another past method of displaying the final results of a game, as illustrated in FIG. 7, includes drawing a line through all images or indicia displayed in a final winning combination.

While the foregoing methods of enhancing the final display of a gaming device have enjoyed some moderate success, they have numerous drawbacks. A primary drawback of the past display methods is that each involves adding something (e.g., a line or border) to the display screen. Thus, with the past methods and devices, additional graphics are required when a final result includes a winning combination. The need to display additional graphics increases the complexity of the gaming device and, perhaps more importantly, increasing the complexity of the visual display viewed by the player. Thus, particularly in the case where multiple winning combinations are present, the display screen becomes cluttered with lines or bordering graphics, often increasing the time required by the player to ascertain the actual winning combination(s). This results in a reduction in the number of games that can be played in a given time period, thus reducing the enjoyment of the user and the revenue generating capability of the device.

Accordingly, the need exists for a gaming device and method in which winning results are easily displayed in a manner which does not increase the cost or complexity of the system. Additionally, the need exists for a gaming device and method for visually enhancing winning combinations generated by a gaming device without adding additional graphics to the display screen. The need also exists for a gaming device and method which allows a player to more quickly determine whether or not the game played has been won, thereby reducing the time lapse between plays of the game and thus increasing the enjoyment to the player and the revenue generating potential of the device. The present invention overcomes the drawbacks and limitations of prior devices and display methods, and fills the foregoing and other needs.

SUMMARY OF THE INVENTION

A primary object of the present invention is to visually enhance winning combinations displayed on a display screen of a gaming device.

Another object of the present invention is to reduce the visual complexity of a gaming device's display screen when winning combinations are generated and displayed by the gaming device.

Still another object of the present invention is to reduce the time it takes the player of a gaming device to determine whether final results displayed by the gaming device include a winning combination.

Still another object of the present invention is to enhance the gaming experience of a player of a gaming device.

Another object of the present invention is to increase the revenue generating potential of a gaming device.

A further object of the present invention is to permit increasingly complex winning combinations to be easily displayed on a display screen of a video gaming device.

These and other objects are achieved by a gaming device and method for visually enhancing a display of the gaming system when winning gaming combinations are generated. The unique gaming device of the present invention, having input devices, memory devices, and output devices, all connected to a central processor, highlights any final winning combination or combinations of indicia generated when the game is played. In one embodiment, this is accomplished by displaying, in a display of the final results of a game having a winning combination, only those indicia associated with the winning combination (either by not displaying the indicia not associated with the winning combination or by initially displaying these non-winning indicia and then removing them). In an alternate embodiment, the present invention highlights any final winning combination(s) of indicia by displaying, in a display of the final results of a game having a winning combination of indicia, each indicia not associated with the winning combination in a faded manner.

The input devices of the present invention include conventional input devices such as a touch screen, switches or levers, and currency acceptors. The memory devices include memory locations for storing controlling system software or instructions for controlling the input and output devices of the gaming device and for controlling the specific game to be played, memory locations for storing statistical data regarding the game, such as the number of times the game is played, the number of wins, etc., and memory locations for storing a bit map of the screen of a video display monitor. The output devices include a hopper into which currency winnings are dispensed, a printer for printing of winnings voucher, the video display monitor, and meters for indicating the number of plays or winnings accumulated.

A player initiates the gaming device of the present invention by inserting currency into the currency acceptor. Through use of the input device, the player activates the game to be played. Once the game is activated, the gaming device (and particularly, gaming control software) randomly generates, in accordance with the game to be played, a final gaming result in the form of a combination of indicia (such as numbers, letters, symbols, or a combination thereof). The final combination of generated indicia is on the video display monitor in accordance with the unique aspects of the present invention.

In the preferred embodiment of the present invention, the display monitor is organized to visually represent multiple spinning reels. Specifically, the software of the present invention controls the display in a manner that displays representations of five side-by-side vertical spinning reels. Each reel displays three indicia, thus resulting in a 5×3 matrix on the video monitor. In accordance with the preferred gaming method of the present invention, three identical indicia or images displayed consecutively in a vertical, horizontal, or diagonal Fashion represents a winning combination.

Once the final results are generated by the gaming software, the present invention compares the final results with preselected winning combinations stored in memory to determine if the final generated results include one or more winning combinations of indicia. In the preferred game described, every combination of three sequentially aligned indicia is compared with the preselected winning combinations stored in memory.

It will be understood by those skilled in the art that gaming systems and devices having the described input devices, a processor, a memory, and output devices have been utilized in the past for providing players with gaming experiences, including games of chance. It will also be understood that the described preferred game involving a winning combination of indicia having three consecutive, identical indicia is representative of a game to be played on the device of the present invention, but that other games, including games representative of card games, such as Black Jack or Poker, games involving a die, bingo, or other games could be played on, and graphically displayed by, the gaming device. Additionally, the gaming software could be developed to including winning combinations other than three consecutive indicia.

In accordance with the unique principles of the present invention, when one or more winning combinations of indicia are found to exist, any indicia not involved in a winning combination is, in one embodiment, not displayed on the screen (or is removed from the screen) in a display of the final results of the game played. In another embodiment, each indicia not associated with a winning combination is displayed in a faded or visually subdued manner on the monitor's screen during a display of the final results of the game played. This simplifies the display and allows the player to immediately focus on the winning combination(s). Unlike past systems, the present invention prevents player confusion and frustration resulting from additional graphics being displayed on the monitor when a winning combination is generated and displayed.

Specifically, as will be understood, the display monitor has a screen defining a matrix of pixel elements, and each indicia displayed as part of the final results of the game is comprised of a collection of selected pixels. In the embodiment of the present invention in which each indicia not involved in a winning combination is not displayed on, or is removed from, the display screen, background display is displayed on the display screen in those locations where the non-winning indicia were, or would have been, displayed.

In the embodiment of the present invention in which each indicia not involved in a winning combination is displayed in a faded manner on the screen, but yet remain partially visible, the controlling software displays only selected pixels—preferably alternate pixels—of those pixels in the indicia's collection of pixels. The remaining pixels are substituted with the background display. The resulting visual effect is that the indicia appears faded on the display monitor.

BRIEF DESCRIPTION OF THE DRAWINGS

The objects and features of the invention noted above are explained in more detail with reference to the drawings, in which like reference numerals denote like elements, and in which:

FIG. 4 is a visual representation of selected winning combinations of indicia as may be used with the present invention;

FIG. 5 illustrates a combination of indicia as they might be displayed when not utilizing the present invention or any other method of visually enhancing winning combinations;

FIGS. 6 and 7 illustrate two different prior art display techniques for displaying the winning final results of a gaming device;

FIG. 8 illustrates the display of a combination of indicia in accordance with a first embodiment of the present invention;

FIG. 9 illustrates the display of a combination of indicia in accordance with a second embodiment of the present invention.

DETAILED DESCRIPTION OF THE INVENTION

Figure 1:
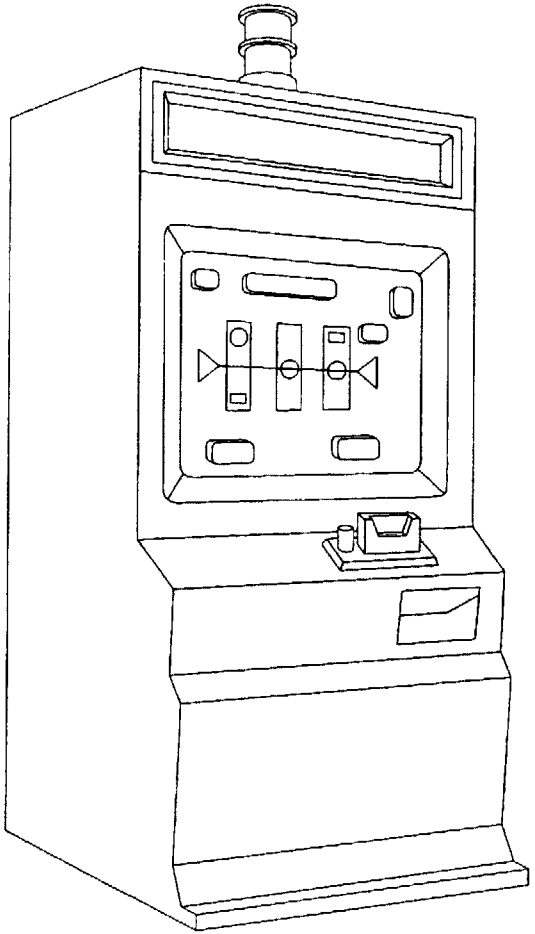
FIG. 1 is a perspective view of a typical gaming device of the type the present invention embodies.

With reference initially to FIG. 1, a conventional gaming device is denoted generally by the reference numeral 10. The present invention is directed to such a gaming device, although having a unique system and method for displaying final results of the game, as described in detail below.

Gaming device 10 has a housing 12, a display area 14, input areas 16, a currency acceptor 18, and a hopper 20 for issuing currency winnings. The input areas 16 are preferably touch screen areas which, when touched by a player, initiate game functions. As will be appreciated, touch screen areas 16 could be substituted with other known input devices, such as switches or buttons, a slot-arm or lever, light pens, etc. Display area 14 is shown as also having a number of display windows 22, as are commonly found on gaming devices for displaying the status of meters, such as a meter for registering the amount of winnings or the number of plays accumulated.

As shown in FIG. 1, display area 14 has three vertically oriented windows 24 defining reel areas. In many past devices, these reel areas housed mechanical reels which would spin when the game was activated. As is well-known, the periphery of these mechanical reels are marked with indicia, such as indicia 26, such that when the reels stop spinning, the presence of identical or selected indicia along a selected pay line, such as the pay line indicated by reference numeral 28, visually indicates a winning combination, typically resulting in a monetary payout to the player.

Technological advancements have resulted in gaming devices, in the nature of gaming device 10, having display areas which utilize video monitors. As will be readily understood by those with skill in the art, and as explained in detail below, the video display monitors now utilized with gaming devices, such as the gaming device of the present invention, have screens comprising a pixel matrix. The video monitors are often arranged to have vertical areas representing a reel, similar to that shown in FIG. 1, and indicia representing the results of the game are randomly generated by a processor and displayed on the monitor in a manner like that shown in FIGS. 5–7, rather than being affixed to the periphery of a mechanical reel. As described above, FIGS. 6 and 7 illustrate prior art attempts at visually indicating the winning combinations of gaming results displayed on a video monitor.

Figure 2:
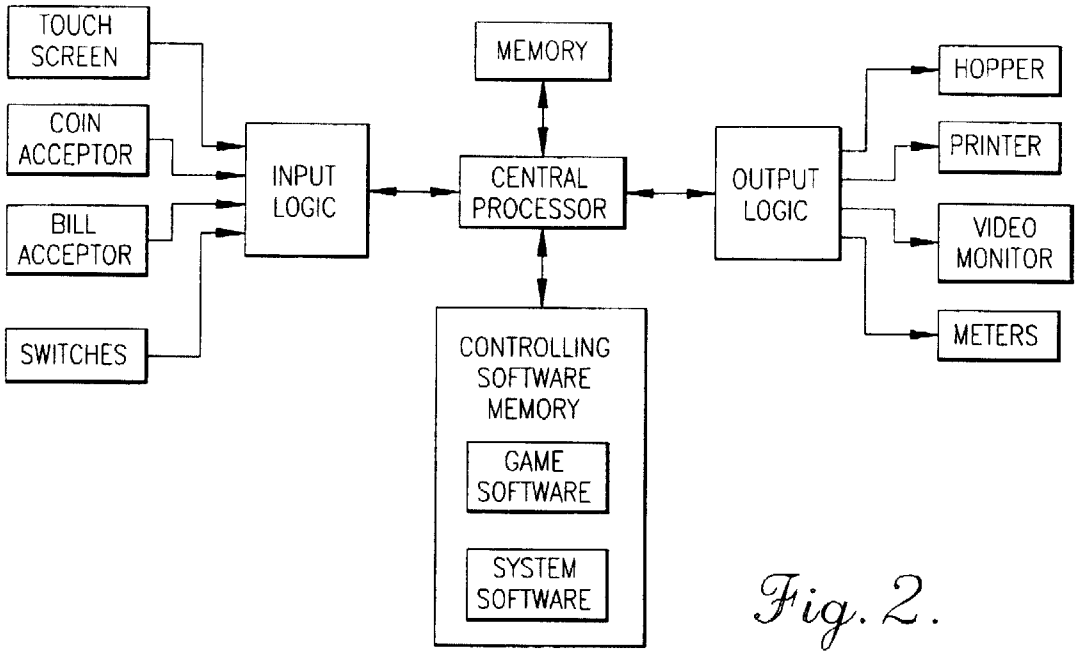
FIG. 2 is a block diagram of the electronic hardware utilized in accordance with the gaming device of the present invention.

With reference now to FIG. 2, the electronic hardware of the gaming device of the present invention is shown and described.

The gaming device of the present invention has a central processor 30 connected to input logic circuitry 32 and output logic circuitry 34. Input logic circuitry 32 connects processor 30 with input devices, such as touch screen 36 and switches 38, and currency acceptors, such as coin acceptor 40 and bill acceptor 42. Output logic circuitry connects processor 30 with output devices, such as currency issuance devices, illustrated as hopper 44, a printer 46, the video monitor 48, and one or more meters 50.

Video monitor 48 is physically located so at to have a display screen visible at the display area 14 of a gaming device 10 as shown in FIG. 1. As shown in FIG. 5, the present invention preferably has the screen of the display monitor oriented into five vertical columns, each of which is designated by the reference numeral 88. Each vertical column preferably displays three indicia, such as indicia 90. Indicia 90 are shown illustratively as symbols of fruit, such as apples 90*a*, oranges 90*b*, and cherries 90*c*.

Central processor 30 is also connected to a controlling software memory 52. Controlling software memory 52 has memory locations for storing game software, as designated by reference numeral 54, and also has memory locations for storing system software, as designated by reference numeral 56. The controlling software of the video gaming device controls when and where selected graphics or messages are displayed to the player. The controlling software determines when the game begins, in response to initiation of the device, and when the game ends, in response to the display of the final combination of indicia or images on the video display monitor. The controlling software also performs processing functions relating to the management of currency input into the currency acceptors and currency issuance devices (such as the hopper).

Central processor 30 is also connected to a second memory device, designated by reference numeral 58. Memory 58 stores data indicative of game statistics, such as the number of plays and the number of wins, etc. One of memory 52 or memory 58 also includes one or more memory locations for storing data indicative of selected winning results, such as data representing one or more combinations of indicia designated as winning combinations. As described in detail below, memory 58 also stores a bit-map of the display screen of monitor 48.

Figure 3:
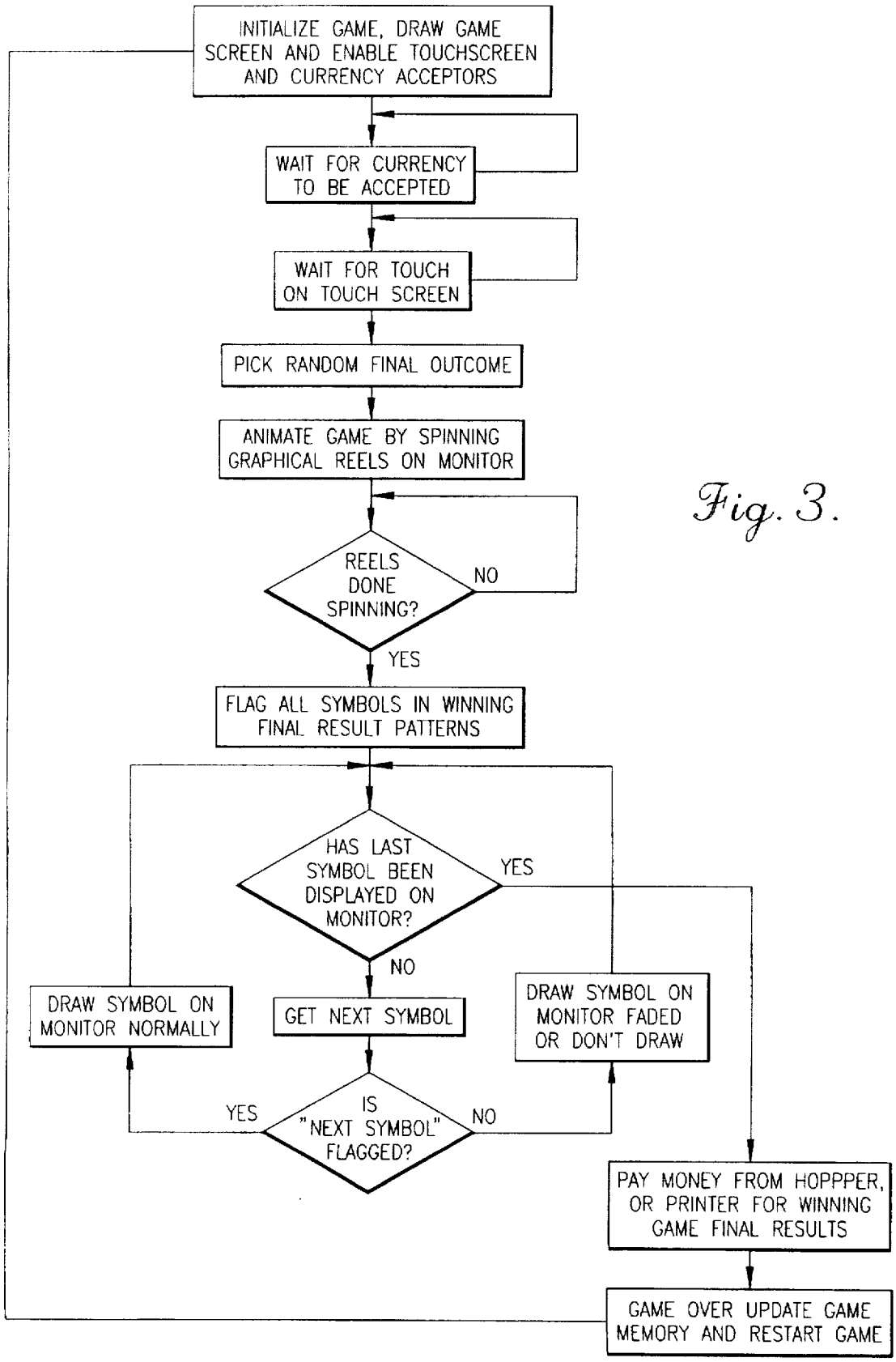
FIG. 3 is a flow chart illustrating the control software and operation of the present invention.

With additional reference to FIG. 3, the operation of the present invention, including the processing operation carried out by processor 30 in conjunction with the system and game software, is illustrated and described.

At step 60, when gaming device 10 of the present invention is initialized, such as by a casino operator, processor 30 carries out a set of instructions of the system software 58 to draw the initial display on the display screen of video monitor 48, and to enable the input devices, such as the touch screen 36, currency acceptors 40, 42, and the switches 38. The gaming device 10 then remains in a waiting state, as indicated at step 62, until currency is introduced into one of the currency acceptors 40, 42 and accepted by processor 30 as a valid currency or token. Once currency is accepted by gaming device 10, the device 10 remains in a waiting state, as indicated at step 64, until an input device, such as touch screen 36, is appropriately activated by a player. The foregoing operation will be readily appreciated by those with skill in the art, as numerous prior systems operate in such a manner.

As indicated at step 66, once the player has initiated the-start of the game through an input device, the game software of the present invention randomly generates indicia, resulting in a random final outcome comprised of a plurality of indicia. Random indicia generators are also well-known, and will be readily understood by those with skill in the art.

As indicated at step 68, the system software of the present invention animates the video monitor 48 by graphically spinning "reels" on the monitor 48. As indicated at steps 70 and 72, once the graphical animation has ceased (e.g., the visual representation of spinning reels has stopped), all generated indicia within a winning combination are flagged.

The manner in which winning combinations of indicia are determined and flagged involves a comparison of the displayed results with the data in memory representing the selected winning combinations. Such a technique is well known in the art, and thus is only briefly described. Once the final game results are generated, the indicia to be displayed are stored in memory 58, in a bit map representing a virtual display. The preferred game of the present invention presents as a winning combination three identical indicia displayed consecutively in a vertical, horizontal, diagonal or scattered fashion. Thus, the system software of the present invention compares each group of three indicia with the results stored in memory to determine if one or more of the generated combinations of three consecutive indicia matches any winning combination stored in memory. For each indicia associated with a winning combination, a memory location associated with that indicia is flagged (e.g., a bit is set) to indicate the indicia's association with a winning combination. It will be understood that three reels are shown for illustrative purposes, but that other games and display characteristics are contemplated by, and within the scope of, the present invention.

Returning now to FIG. 3, once all indicia (e.g., symbols) 90 associated with a winning combination have been flagged at step 72, the gaming device 10 retrieves data representative of the generated indicia from memory 58 and displays the final results of the game on the display screen of monitor 48 in accordance with the unique principles of the present invention. Specifically, when carrying out the display of the final results of the game, and it is determined by the processing of the present invention at step 74 that all symbols have not yet been displayed on the display monitor 48, another indicia is retrieved from memory 58 as indicated at step 76. When, as determined at step 78, the retrieved indicia or symbol is flagged, indicating its association with a winning combination, it is drawn or displayed on video monitor 48 in normal fashion, as indicated as processing step 80. When, however, it is determined at step 78 that the symbol or indicia retrieved from memory is not flagged, indicating that it is not associated with a winning combination, it is drawn or displayed on video monitor 48 in accordance with a specific embodiment of this invention. Specifically, as indicated at the processing step designated by reference numeral 82, each indicia not associated with a winning combination is, in one embodiment, drawn or displayed on video monitor 48 in a faded manner. In an alternate embodiment, each indicia not associated with a winning combination is simply not displayed on monitor 48 in a display of the final results of the game played.

Once it has been determined at processing step 74 that all indicia generated by the game have been retrieved from memory, any winnings to be paid to the player are dispensed into hopper 44 or are printed from printer 46, as indicated at processing step 84. Step 86 represents that the game is over, statistical game data stored in memory 58 is updated, and the processing returns to the start.

With reference now to FIGS. 5, 8, 9, and 10, processing step 82 of FIG. 3, in which each indicia 90 not associated with a winning combination is either not displayed or is displayed in a faded manner during a display of the final results of a game played, is described in detail.

Initially, as shown in FIG. 5, the present invention preferably has the screen of the display monitor oriented into five vertical columns, each of which is designated by the reference numeral 88. Each vertical column preferably is capable of displaying three indicia, such as indicia 90. Indicia 90 are shown illustratively as symbols of fruit, such as apples 90*a*, oranges 90*b*, and cherries 90*c*.

Figure 10:
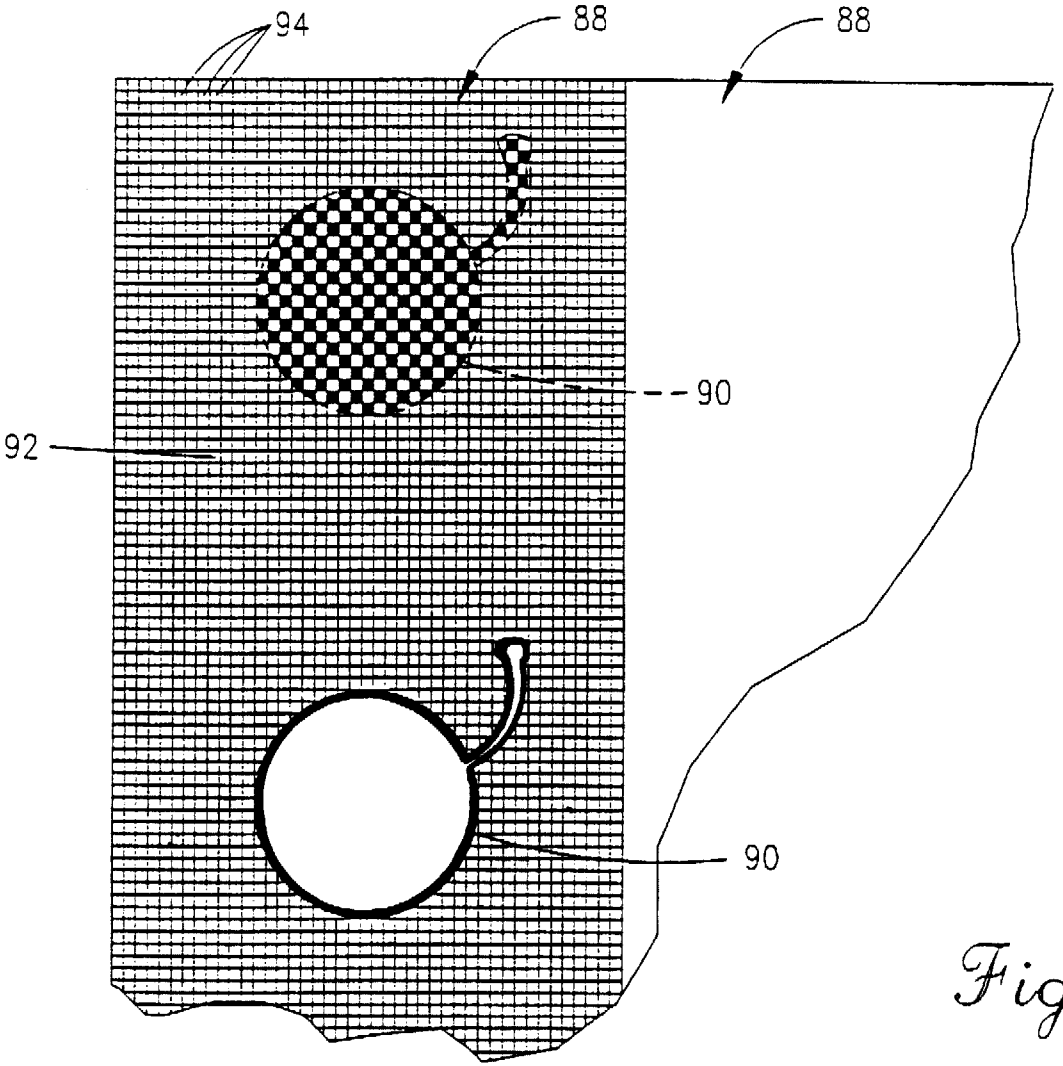
FIG. 10 illustrates in a greatly enlarged manner a portion of the display screen of a display monitor of the present invention and, particularly, individual pixels of the screen.

With specific reference to FIGS. 8 and 10, in accordance with one embodiment of the present invention, each indicia 90 not associated with a winning combination is displayed on display screen 92 in a faded manner (illustrated by broken lines). Thus, winning combinations of indicia—in this case, three consecutive identical indicia—are readily visible to the player. FIG. 10 illustrates a portion of a display screen 92 of video monitor 48. Display screen 92 is defined by, and comprised of, a matrix of pixels 94, as will be readily understood. Elaborate graphical processing systems currently exist, and graphically displaying images on a display screen will also be readily understood by those with skill in the art. Each pixel 92 has an associated memory address such that a bit-map representing display screen 92 is stored in memory. Thus, each pixel 94 has a corresponding address in memory such that control of the display screen 92 at any given pixel is controlled by the data stored in its corresponding address in memory.

As illustrated in FIG. 10, an indicia 90 not associated with a winning combination is displayed in a faded manner by displaying only alternate pixels of the collection of pixels defining the indicia 90. As will be readily understood in view of the foregoing, each pixel area has an exclusive memory address, and the display of the indicia in a faded manner is accomplished by storing data for visually representing the indicia in only a portion of the addresses corresponding to the collection of pixels defining the indicia. The memory addresses corresponding to the remaining pixel areas in the collection of pixels defining the indicia are stored with uniform data for visually displaying a uniform background or neutral display, resulting in a faded appearance of the indicia 90 not associated with a winning combination.

Alternatively, fading of non-winning indicia or of indicia not associated with a winning combination of indicia can be accomplished according to the principles of the present invention by writing the entire indicia with fainter colors on each pixel or selected pixel. In this regard, red-green-blue (RGB) signals transmitted to each pixel can be adjusted, in any known fashion, to display the subject indicia in a color that is fainter or a lighter shade than the indicia as normally displayed. Alternatively, or additionally, winning indicia can be enhanced by displaying them with brighter or more distinguishing colors. Fading can also be accomplished in accordance with the principles of the present invention by altering the pixels in a collection of pixels defining an indicia so as to leave the appearance of an outline of the indicia. As will now be clearly understood, an important principal of the present invention is to display a losing indicia, or all indicia not associated with a winning combination, in a manner that is less dominate than winning indicia or the indicia that are associated with a winning combination.

With reference now specifically to FIG. 9, the alternative embodiment of the present invention, each indicia 90 generated by the game but not associated with a winning combination of indicia is not displayed on screen 92 of monitor 48 in a display of the final results of the game played. In this embodiment, rather than displaying only a portion of the pixels of a non-winning indicia 90, none of the pixels defining the indicia 90 are displayed as such. Rather, each pixel area of the screen 92 which would include a portion of an indicia 90 not associated with a winning combination is displayed with a uniform or neutral background display. Thus, memory address locations defining a pixel area of an indicia 90 that is not associated with a winning combination are stored with data indicative of a uniform background or neutral display, preferably white in color, and the display screen 92 visually displays only background (and no indicia) in corresponding locations. Preferably, the display of the winning results absent losing indicia is accomplished by removing the non-winning indicia from a display of all indicia in the final result of the game played. Alternatively, however, only the indicia associated with a winning combination could be displayed thereby not requiring a step of removing certain indicia.

As will now be readily understood in view of the foregoing description of the present invention, one preferred method of the present invention is accomplished by displaying, in a display of the final results of the game, only those indicia in a winning combination when a winning combination is present. As also described, a display of the final results of the game could embody the initial display of the final results including only indicia associated with a winning combination, or could embody an updated display which has removed therefrom all indicia not associated with a winning combination. The second method of the present invention is accomplished by displaying, in a display of the final results of the game, all indicia not associated with a winning combination in a faded manner. A display of the final results using this method can similarly be accomplished by initially displaying the final results in the described manner or by updating a display of all generated indicia to display those indicia not associated with a winning combination in a faded manner.

The described invention allows the game player to quickly determine what, if any, winning and losing combinations of indicia have been generated during play of the game. This reduces the time required by the game player to initiate a new game sequence, thus enhancing the game experience to the player and the revenue generating potential of the device. Additionally, the invention reduces the potential of player confusion and frustration resulting from prior art techniques of adding graphics to the display to indicate a winning combination, especially where numerous winning combinations are simultaneously presented on the display screen. Thus, the present invention also lends itself to more complex gaming experiences and a wider variety of winning combinations.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A gaming device for playing a game, said device comprising:

a processor for generating a plurality of indicia when said game is played;

a memory having stored therein data representative of a selected winning combination of indicia;

a monitor having a screen for displaying said plurality of generated indicia wherein, when said plurality of generated indicia includes said selected winning combination of indicia, each indicia of said plurality of generated indicia that is not in said winning combination is displayed by said processor in a faded manner on said screen of said monitor.

2. The gaming device as set forth in claim 1 wherein each said generated indicia is defined by a plurality of address locations corresponding to pixels on a display screen of said display monitor, and wherein a portion of the address locations of each said indicia not associated with a winning combination are stored with data indicative of, and for displaying, a background display.

3. The gaming device as set forth in claim 1 wherein each said generated indicia that is associated with a winning combination is displayed fully in a display of the results of the game played.

4. The gaming device as set forth in claim 1 wherein said screen comprises a pixel matrix and each said indicia of said plurality of generated indicia is comprised of a collection of selected pixels, wherein said processor fades each said indicia not associated with said winning combination is faded by displaying a selected plurality of the pixels in its said collection of pixels with a background display.

5. The gaming device as set forth in claim 4 wherein said processor fades each said indicia not associated with said winning combination by displaying alternate pixels in its said collection of pixels with said background display.

6. The gaming device as set forth in claim 1 wherein said processor initially fully displays each said indicia of said plurality of generated indicia that is not in said winning combination on said screen along with the full display of each indicia included in a winning combination, and then said processor displays said non-winning indicia in a faded manner on said screen.

7. A gaming device for playing a game, said device comprising:

a processor for generating final results when said game is played;

a screen for graphically displaying said final results wherein, when said final results include a winning result and a non-winning result, said non-winning result is displayed on said screen in a manner that is less dominant than the display of said results;

wherein said processor displays non-winning results in a faded manner on said screen.

8. A gaming device for playing a game, said device comprising:

a processor for generating final results when said game is played;

a screen for graphically displaying said final results wherein, when said final results include a winning result and a non-winning result, said non-winning result is displayed on said screen in a manner that is less dominant than the display of said results;

wherein said non-winning results are outline on said screen.

* * * * *

UNITED STATES PATENT AND TRADEMARK OFFICE

CERTIFICATE OF CORRECTION

PATENT NO. : 5,766,074
DATED : June 16, 1998
INVENTOR(S) : Lee Cannon et al.

It is certified that error appears in the above-identified patent and that said Letters Patent is hereby corrected as shown below:

The title page should be deleted and substitute therefore the attached title page.

United States Patent [19]

Cannon et al.

[11] Patent Number: 5,766,074

[45] Date of Patent: Jun. 16, 1998

[54] DEVICE AND METHOD FOR DISPLAYING A FINAL GAMING RESULT

[75] Inventors: Lee Cannon; John O'Donovan, both of Bozeman, Mont.

[73] Assignee: Video Lottery Technologies, Atlanta, Ga.

[21] Appl. No.: 692,575

[22] Filed: Aug. 6, 1996

[51] Int. Cl.[6] ..... A63F 9/00

[52] U.S. Cl. ..... 463/16; 463/31

[58] Field of Search ..... 463/8, 16, 30, 463/31, 33; 273/138.1, 139, 269

[56] References Cited

U.S. PATENT DOCUMENTS

| | | | |
|---|---|---|---|
| 4,491,324 | 1/1985 | Yoshida | 463/8 |
| 4,573,681 | 3/1986 | Okada | 273/143 R |
| 4,711,451 | 12/1987 | Pajak et al. | 273/143 R |
| 4,772,023 | 9/1988 | Okada | 273/143 R |
| 4,858,932 | 8/1989 | Keane | 273/143 R |
| 5,050,881 | 9/1991 | Nagao | 273/143 R |
| 5,083,785 | 1/1992 | Okada | 273/143 R |
| 5,085,436 | 2/1992 | Bennett | 273/143 R |
| 5,108,099 | 4/1992 | Smyth | 273/138 |
| 5,127,651 | 7/1992 | Okada | 273/143 R |
| 5,129,652 | 7/1992 | Wilkinson | 273/139 |
| 5,152,529 | 10/1992 | Okada | 273/143 R |
| 5,169,147 | 12/1992 | Hamano | 273/138 |
| 5,170,468 | 12/1992 | Shah et al. | 395/166 |
| 5,242,163 | 9/1993 | Fulton | 273/85 |
| 5,249,800 | 10/1993 | Hilgendorf et al. | 273/138 |
| 5,254,984 | 10/1993 | Wakeland | 345/144 |
| 5,265,874 | 11/1993 | Dickinson et al. | 273/138 |
| 5,269,523 | 12/1993 | Boylan et al. | 273/138.1 |
| 5,280,909 | 1/1994 | Tracy | 273/138 |
| 5,282,620 | 2/1994 | Keese | 273/138 |
| 5,324,035 | 6/1994 | Morris et al. | 273/138 |
| 5,326,104 | 7/1994 | Pease et al. | 273/138 |
| 5,340,119 | 8/1994 | Goldfarb | 273/439 |
| 5,388,192 | 2/1995 | Ohsawa et al. | 395/135 |
| 5,505,449 | 4/1996 | Eberhardt et al. | 273/138 A |
| 5,511,784 | 4/1996 | Furry et al. | 273/143 R |
| 5,559,950 | 9/1996 | Cannon | 395/162 |

*Primary Examiner*—George Manuel

*Attorney, Agent, or Firm*—Shook, Hardy & Bacon LLP

[57] ABSTRACT

A device and method for displaying a final gaming result, in one embodiment, displays on a video monitor the winning results in a complete manner and all non-winning results in a faded manner. In an alternate embodiment, when a game produces winning results, only the winning results of the game are displayed. Specifically, a video game device has a processor, a video monitor with display screen, and a memory for storing a bit map of the screen. Non-winning results in one embodiment are not displayed or are replaced with a background display. In another embodiment, non-winning results are displayed in a faded manner by substituting selected pixels of a collection of pixels defining an non-winning indicia to be displayed with a background or neutral display. The desired results are achieved by storing data indicative of the desired display in address locations corresponding to pixels on the screen.

8 Claims, 5 Drawing Sheets

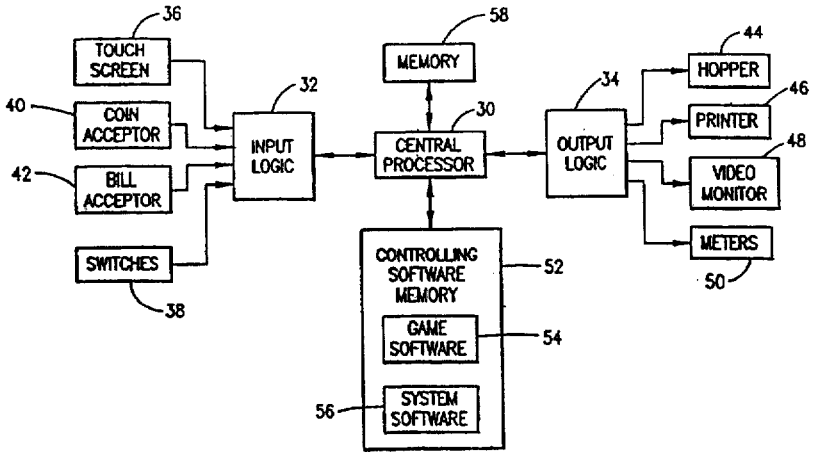

UNITED STATES PATENT AND TRADEMARK OFFICE

CERTIFICATE OF CORRECTION

PATENT NO. : 5,766,074
DATED : June 16, 1998
INVENTOR(S) : Lee Cannon et al.

It is certified that error appears in the above-identified patent and that said Letters Patent is hereby corrected as shown below:

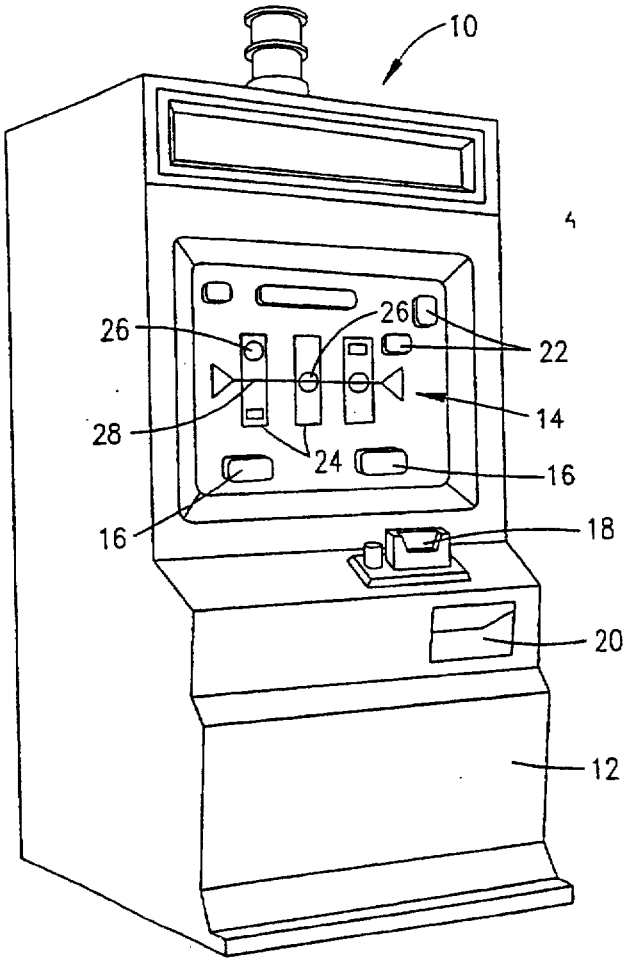

Fig. 1.

UNITED STATES PATENT AND TRADEMARK OFFICE

CERTIFICATE OF CORRECTION

PATENT NO. : 5,766,074
DATED : June 16, 1998
INVENTOR(S) : Lee Cannon et al.

It is certified that error appears in the above-identified patent and that said Letters Patent is hereby corrected as shown below:

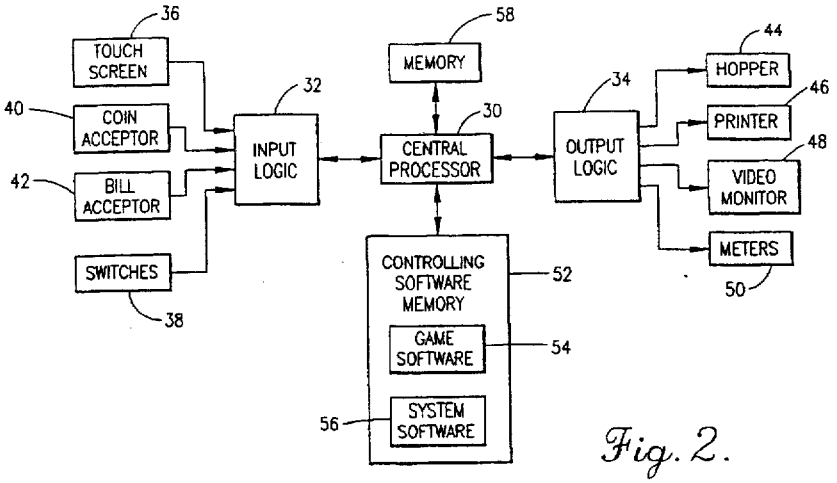

Fig. 2.

UNITED STATES PATENT AND TRADEMARK OFFICE

CERTIFICATE OF CORRECTION

PATENT NO. : 5,766,074
DATED : June 16, 1998
INVENTOR(S) : Lee Cannon et al.

It is certified that error appears in the above-identified patent and that said Letters Patent is hereby corrected as shown below:

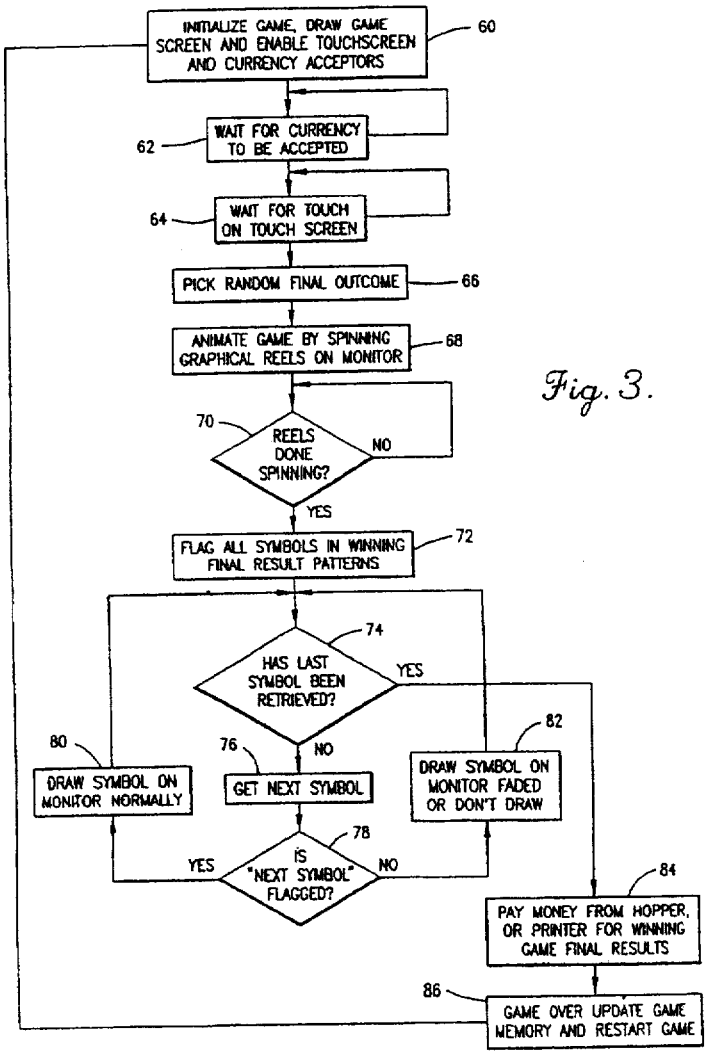

*Fig. 3.*

UNITED STATES PATENT AND TRADEMARK OFFICE

CERTIFICATE OF CORRECTION

PATENT NO. : 5,766,074
DATED : June 16, 1998
INVENTOR(S) : Lee Cannon et al.

It is certified that error appears in the above-identified patent and that said Letters Patent is hereby corrected as shown below:

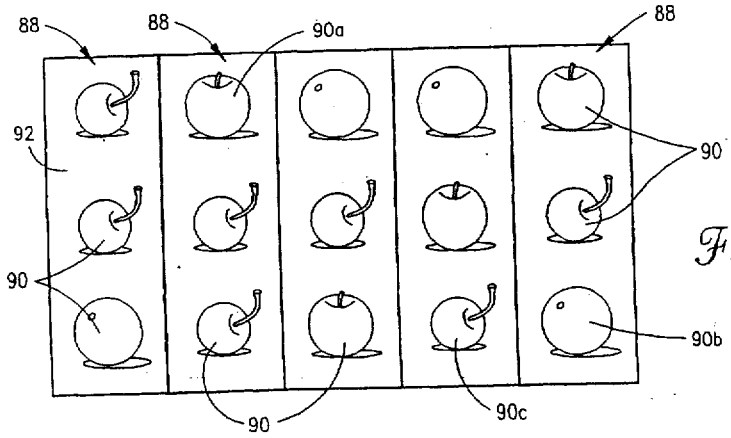

Fig. 5

UNITED STATES PATENT AND TRADEMARK OFFICE

CERTIFICATE OF CORRECTION

PATENT NO. : 5,766,074
DATED : June 16, 1998
INVENTOR(S) : Lee Cannon et al.

It is certified that error appears in the above-identified patent and that said Letters Patent is hereby corrected as shown below:

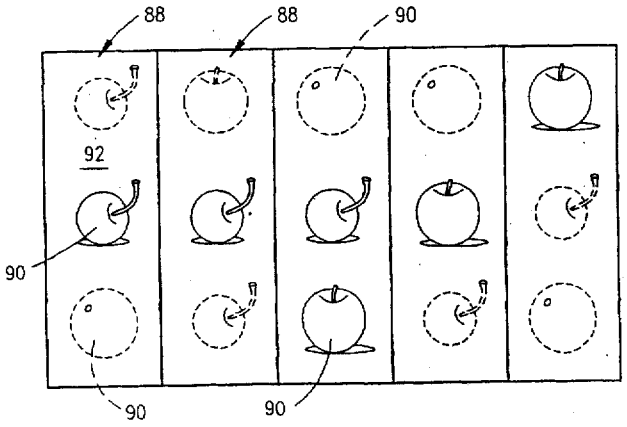

Fig. 8.

UNITED STATES PATENT AND TRADEMARK OFFICE

CERTIFICATE OF CORRECTION

PATENT NO. : 5,766,074
DATED : June 16, 1998
INVENTOR(S) : Lee Cannon et al.

It is certified that error appears in the above-identified patent and that said Letters Patent is hereby corrected as shown below:

Fig. 9.

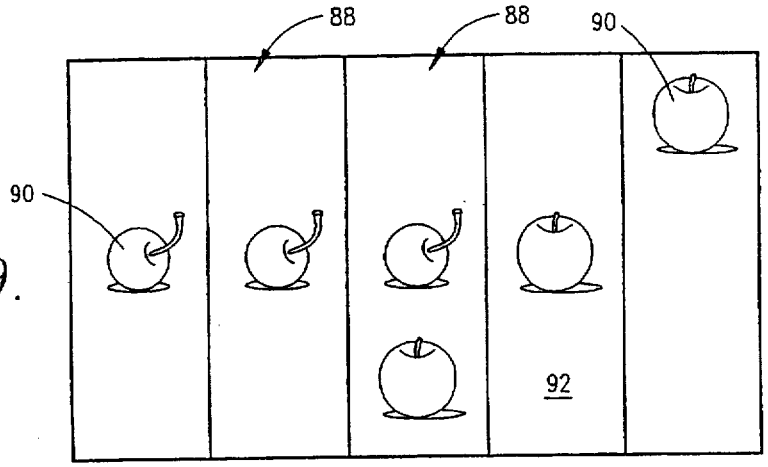

Signed and Sealed this

Eighteenth Day of December, 2001

*Attest:*

*Attesting Officer*

JAMES E. ROGAN
*Director of the United States Patent and Trademark Office*